US009199501B2

(12) United States Patent
De Gaillande

(10) Patent No.: US 9,199,501 B2
(45) Date of Patent: Dec. 1, 2015

(54) FEED MODULE FOR SUPPLYING STAMPING FOIL

(71) Applicant: BOBST MEX SA, Mex (CH)

(72) Inventor: Christophe De Gaillande, Bussigny (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 14/387,904

(22) PCT Filed: Mar. 20, 2013

(86) PCT No.: PCT/EP2013/000842

§ 371 (c)(1),
(2) Date: Sep. 25, 2014

(87) PCT Pub. No.: WO2013/143664

PCT Pub. Date: Oct. 3, 2013

(65) Prior Publication Data

US 2015/0047523 A1 Feb. 19, 2015

(30) Foreign Application Priority Data

Mar. 28, 2012 (EP) ..... 12002228

(51) Int. Cl.

| | |
|---|---|
| ***B41F 1/28*** | (2006.01) |
| ***B41K 3/02*** | (2006.01) |
| ***B41K 3/04*** | (2006.01) |
| ***B41F 19/00*** | (2006.01) |

(52) U.S. Cl.
CPC . *B41K 3/02* (2013.01); *B41F 19/00* (2013.01); *B41K 3/04* (2013.01)

(58) Field of Classification Search
CPC ..... B41K 3/04
USPC ..... 101/407.1
See application file for complete search history.

(56) References Cited

U.S. PATENT DOCUMENTS

| | | | | |
|---|---|---|---|---|
| 2,080,507 | A * | 5/1937 | Robertson | 235/130 R |
| 3,307,441 | A * | 3/1967 | Saunders | B31F 1/28 83/106 |
| 3,816,207 | A * | 6/1974 | Robertson et al. | 156/238 |
| 4,343,670 | A * | 8/1982 | Brown | B41F 17/14 156/233 |
| 5,207,855 | A * | 5/1993 | Nyfeler | B41F 19/062 156/351 |
| 5,730,056 | A * | 3/1998 | Schmitt | B41F 13/56 101/232 |
| 6,467,404 | B1 * | 10/2002 | Griffin et al. | 101/21 |
| 7,469,633 | B2 * | 12/2008 | Newsome, III | 100/215 |
| 2004/0045660 | A1 * | 3/2004 | Chojnacki | 156/230 |

FOREIGN PATENT DOCUMENTS

WO WO 2012/034645 A1 3/2012

OTHER PUBLICATIONS

International Search Report dated May 8, 2013 issued in corresponding International patent application No. PCT/EP2013/000842.

* cited by examiner

*Primary Examiner* — Anthony Nguyen
(74) *Attorney, Agent, or Firm* — Ostrolenk Faber LLP

(57) ABSTRACT

A feed module for supplying stamping foil for a stamping printing machine, comprising a support for at least one reel of foil to be stamped, and a drive for each such stamping foil. The support and the drive are set in a workspace which is arranged in an upper portion of the module, and the lower portion of the module has a free space which is laterally accessible from the outside and which communicates upwardly with the workspace at a top of the free space.

10 Claims, 3 Drawing Sheets

FEED MODULE FOR SUPPLYING STAMPING FOIL

CROSS-REFERENCE TO RELATED APPLICATIONS

The present application is a 35 U.S.C. §§371 national phase conversion of PCT/EP2013/000842, filed Mar. 20, 2013, which claims priority of European Patent Application No. 12002228.0 filed Mar. 28, 2012, the contents of which are incorporated by reference herein. The PCT International Application was published in the French language.

FIELD OF THE INVENTION

The present invention relates to a module for supplying stamping foil, and to a machine capable of printing by stamping a succession of flat sheet-like elements.

The invention is used particularly advantageously but not exclusively in the field of production of packagings intended for the luxury goods industry.

BACKGROUND OF THE INVENTION

It is known to print text and/or patterns by means of stamping, that is to say to deposit, by means of pressure on a sheet-like support, some colored or metalized coating from one or more strips to be stamped which are commonly referred to as metalized stamping foils. In industry, such a transfer operation is usually carried out by means of a platen-type press in which the printing supports are introduced sheet by sheet while each stamping foil is supplied continuously.

Among stamping printing machines which are known from the prior art, there are those in which the supply with stamping foil is carried out from an internal module which mainly combines the foils stored in the form of reels, and their drive system. Such a feed module may be in the form of a specific station or may be integrated in a dedicated zone of another workstation of the stamping machine.

Inside the feed module, the reels are generally mounted on a removable cassette-type support which is mounted in a sliding manner perpendicularly to the axis of the stamping machine. Therefore, the module is loaded by laterally withdrawing the support, by positioning each reel manually or by means of a lifting carriage, then by returning the support transversely into the machine.

However, such an internal feed module has the disadvantage of involving relatively long loading times. It also requires a large amount of floor space around the machine in order to allow, on the one hand, the removal of the cassette-type support and, on the other hand, the handling operations of the lifting carriage. In particular, however, the transverse movement of the cassette-type support produces a systematic creasing of the foils which are already present inside the feed module, and this is found to be particularly damaging in the end, from an economic point of view.

In order to overcome those difficulties, consideration has been given to using an external feed module, that is to say assembling the set of reels in a cabinet set up outside but near the stamping machine, and adopting a drive system which is capable of drawing and guiding each stamping foil in particular between said cabinet and said machine.

Although such an arrangement obviously allows the loading of the reels to be made easier and the problems involving creasing of foils to be overcome, it remains the case that it still requires a large amount of floor space. Furthermore, the off-center positioning of the external feed module involves a length of foil in the machine which is substantially greater than that which is necessary with an internal module. This has the effect of significantly diminishing the dynamic behavior of the foils during the stamping operation, but also of increasing their respective positioning times.

SUMMARY OF THE INVENTION

Therefore, the technical problem to be solved by the subject-matter of the present invention is to provide a feed module for supplying stamping foils for a stamping printing machine, comprising support means for at least one reel of stamping foil, and drive means for each stamping foil, which feed module would allow the problems of the prior art to be overcome by providing in particular substantially facilitated loading of reels while maintaining the integrity of the stamping foils.

According to the present invention, the solution to the technical problem posed involves the support means and the drive means being set up in a workspace which is arranged in the upper portion of the module, and the lower portion of the module comprising a free space which is laterally accessible from the outside and which communicates with the workspace via the top.

It is important to specify that, throughout this text, the notion of a stamping printing machine more generally extends to any processing machine, one of the functions of which involves printing by stamping. For example, there may be envisaged here a forming machine in which cutting and printing by stamping are carried out at the same time.

The notion of drive means must itself be understood in the broad sense. This means that even if it primarily designates foil advance means, it may also relate to other related functions, such as unrolling the foil, guiding, maintaining tension, etc.

Finally, it should be noted that the invention may be used equally well with an internal feed module and an external feed module.

Be that as it may, the invention as defined has the advantage of being extremely rapid to load. This is because this operation simply involves laterally introducing each reel in the lower portion of the module, then transferring it to the upper portion before positioning it in its final operating position. Such loading kinematics via the bottom do not require that additional floor space be provided near the feed module and simple lateral access is sufficient. Furthermore, any new reel is loaded in an individual manner, that is to say, without requiring the simultaneous removal of the ones already in place inside the module, thereby eliminating any risk of creasing of foils.

The present invention further relates to the features which will become apparent from the following description and which should be considered alone or in any technically possible combination thereof. This description, which is given by way of non-limiting example, is intended for better comprehension of what the invention involves and how it may be carried out.

BRIEF DESCRIPTION OF THE DRAWINGS

The description is further given with reference to the appended drawings, in which.

For reasons of clarity, the same elements have been given identical reference numerals. Similarly, only the elements essential to the understanding of the invention have been illustrated, in a schematic manner and without being to scale.

DESCRIPTION OF EMBODIMENTS

Figure 1:
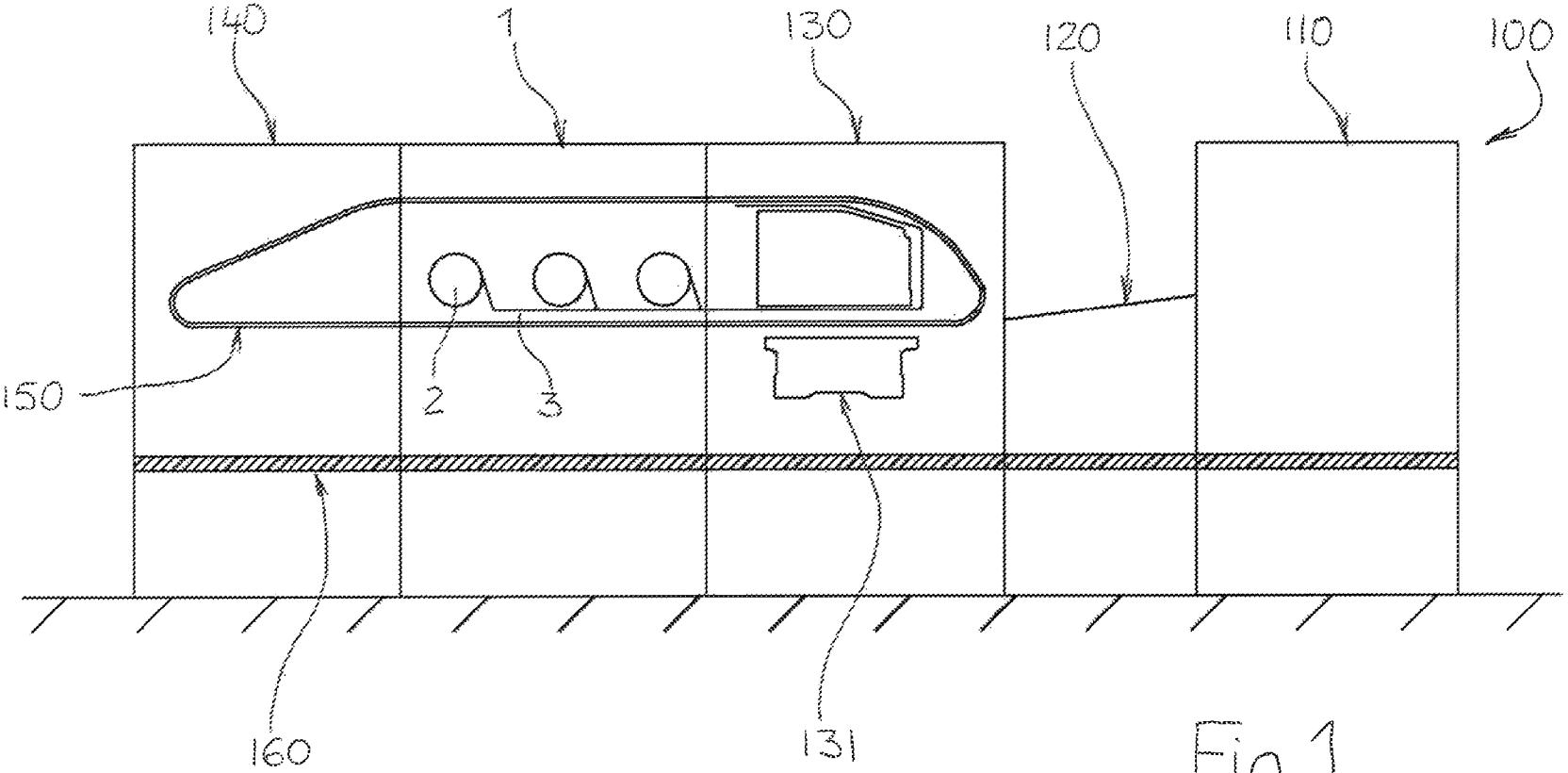
FIG. 1 illustrates a stamping printing machine in which a feed module according to the invention is integrated.

FIG. 1 illustrates a stamping printing machine 100 which allows the cardboard packagings intended for the luxury goods industry to be personalized. Such a stamping machine, which is generally referred to as a gilding machine, is extremely well known in the prior art. Therefore, it will not be described in detail here either in terms of its structure or its operation.

It will simply be noted that this stamping machine 100 conventionally comprises a plurality of workstations 110, 120, 130, 1, 140 which are juxtaposed in order to form a unitary assembly which is capable of processing a succession of flat sheet-like elements. Thus, there are provided a feeder 110 which is intended to supply the machine sheet by sheet, a feed table 120 on which the sheets are placed in layers before being positioned precisely and individually, a stamping station 130 which uses a platen press 161 in order to deposit on each sheet, by hot stamping, some metalized coating from a plurality of stamping foils 3, an internal module 1 for supplying the machine 100 with stamping foils 3 which are stored in the form of reels 2, and a delivery station 140 which is intended for restacking the previously processed sheets. Transport means 150 are further provided in order to displace individually each sheet from the output of the feed table 120 as far as the delivery station 140, including through the stamping station 130.

Figure 2:
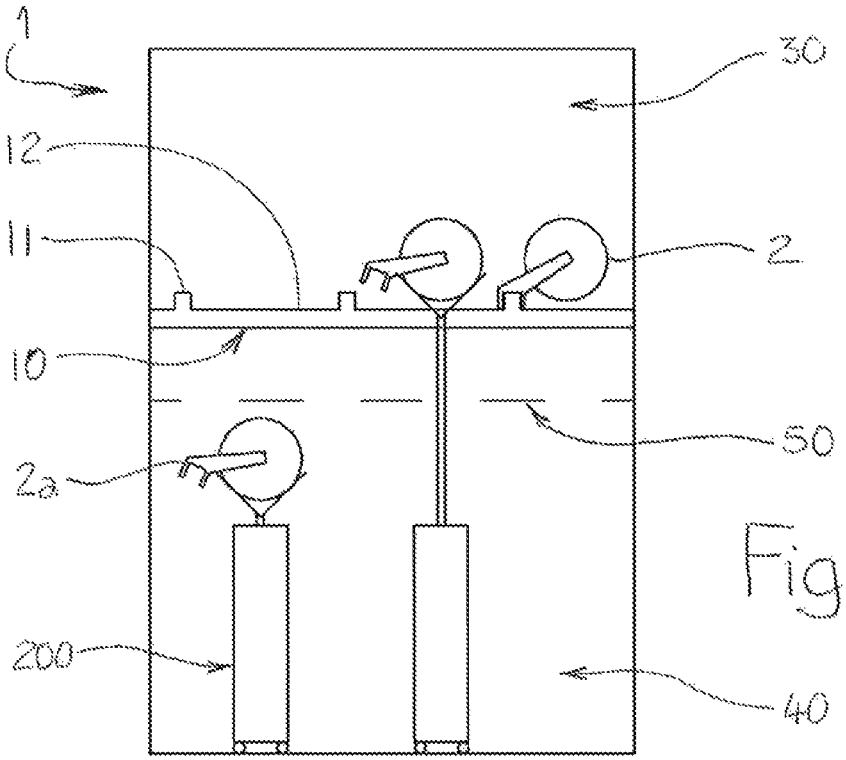
FIG. 2 is a side view of the feed module, in which the loading of a reel of stamping foil is schematically indicated.
Figure 3:
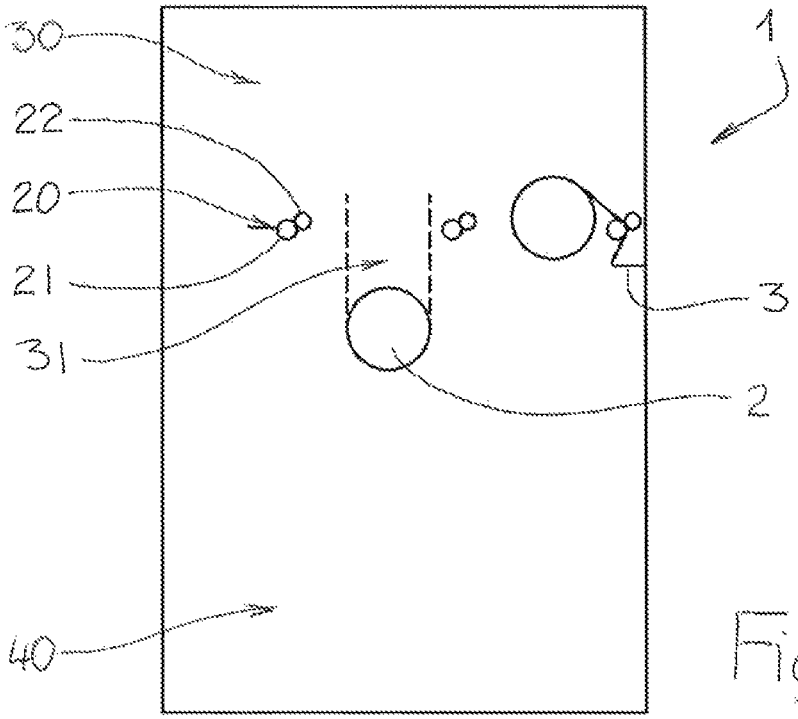
FIG. 3 is a view which is similar to FIG. 2 but which this time shows the relative mobility between the reels and the means for driving foils which are associated therewith.

As can clearly be seen in FIGS. 2 and 3, the feed module 1 has, on the one hand, means 10 which are capable of supporting three reels 2 of foils 3 to be stamped and, on the other hand, means 20 which are capable of driving the advance of each stamping foil 3.

According to the subject-matter of the present invention, the support means 10 and the drive means 20 are assembled in a workspace 30 which is arranged in the upper portion of the feed module 1. Furthermore, the lower portion of the module 1 itself comprises a free space 40 which is laterally accessible from the outside of the module 1 and which communicates with the workspace 30 via the top.

According to a particular feature of the invention that is visible in FIG. 2, the free space 40 is configured so as to be able to receive external lifting means 200 for at least one reel 2. The assembly is further arranged in such a manner that these external lifting means 200 can, on the one hand, transport each reel 2 during its introduction into the free space 40 in a substantially transverse direction and, on the other hand, transfer each reel 2 from the free space 40 to the workspace 30 in a substantially vertical direction.

In other words, this means that the free space 40 has such dimensions that each reel 2 and the lifting means 200 which are associated therewith can be introduced therein simultaneously. However, that also indicates that the free space 40 is configured so as to allow the use of the lifting means 200, that is to say the lifting and the introduction of each reel into the workspace 30.

The presence of the external lifting means 200 is a priori only temporary inside the free space 40, which implies that they are supposed to be removed therefrom at the end of the process for loading the reels 2. These lifting means 200 may be of the individual type or collective type with regard to the set of reels 2 to be loaded in the feed module 1. In the present case, they are in the form of a movable unit which is capable of moving by rolling and of lifting the reels 2 one by one.

According to another particular feature which may also be seen in FIGS. 2 and 3, the workspace 30 comprises at least one cross-section 31 which extends substantially vertically and which is dedicated to the transfer of reels 2 between the free space 40 and the workspace 30 (dotted zone in FIG. 3). According to that logic, the support means 10 and the drive means 20 are set up outside each cross-section 31.

In this embodiment, the support means 10 mainly comprise three horizontal cross-members 11 which are carried at their ends by two lateral supports 12 which are fixedly joined to the structure of the module 1, and which extend transversely inside the workspace 30. In a state positioned in a coplanar and regularly spaced-apart manner, these three cross-members 11 are conventionally configured in order to co-operate by means of interlocking with the reel-carrying arms 2*a* of each reel 2.

The drive means 20 are also themselves generally formed, for each reel 2, by the association of an advance shaft 21 and a pressing roller 22. The three advance shafts 21 are also set up in a coplanar manner in this instance, with a regular spacing which is sufficient to allow each reel 2 connected to its reel-carrying arms 2*a* to pass. This applies similarly with regard to the three pressing rollers 22.

FIG. 2 further shows that the feed module is also provided with separation means 50 which are capable of physically separating the workspace 30 and the free space 40 temporarily.

In this embodiment, the separation means 50 are in the form of a slatted roller shutter which is mounted so as to slide horizontally in order to be able to be deployed as required. Its use is mainly intended to prevent any access between the free space 40 and the workspace 30. However, its presence is also advantageous for supporting the sheets present in the feed module 1 when the transport means 150 are inoperative.

Figure 4:
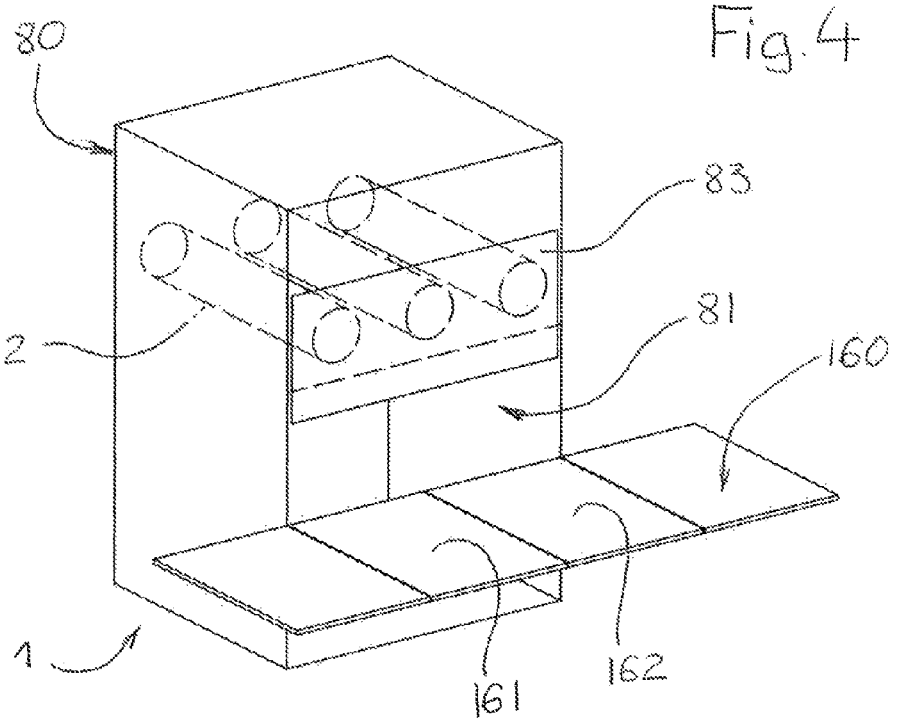
FIG. 4 is a perspective side view from above which shows the feed module in an operating position.
Figure 5:
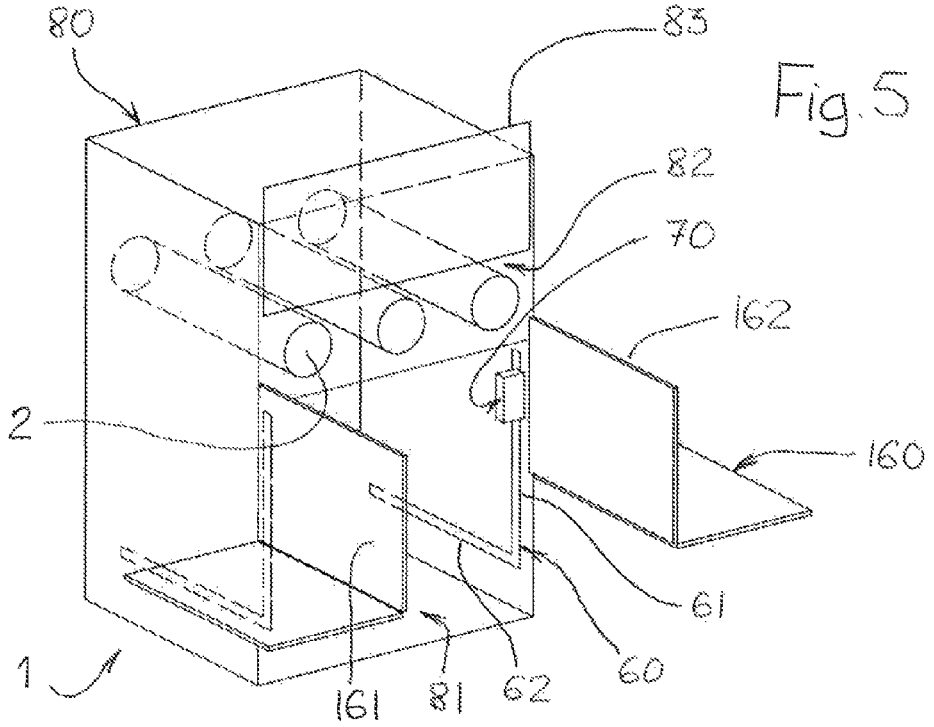
FIG. 5 is a view similar to FIG. 4 but with the feed module in a loading position.

According to FIGS. 4 and 5, in this specific embodiment selected only by way of example, the workspace 30 and the free space 40 are delimited by a chamber 80 which is provided with at least one lower opening 81 which affords access to the free space 40 from the outside of the module 1.

Besides its purely structural and esthetic functions, the chamber 80 fulfills an obvious function of protection, both with regard to the persons who are present around the stamping machine 100 (physical protection, sound protection, etc.) and with regard to the mechanisms which are present inside the module 1 (physical protection, protection against dust and other dirt, etc.). For this reason, in this embodiment, the number of lower openings 81 is limited to one unit which is arranged laterally at the operator side of the stamping machine 100.

In a particularly advantageous manner, the feed module 1 further has detection means 60 which are capable of identifying any intrusion into the free space from the outside of the module 1. In this embodiment, the detection means 60 are conventionally formed by two light barriers 61, 62 which are set up vertically at the entrance and horizontally at the base of the free space 40, respectively.

According to another advantageous feature, the chamber 80 further comprises at least one upper opening 82 which affords access to the workspace 30. The advantage of such a particular feature is to be able to gain direct access to the reels 2, the support means 10 thereof, the drive means 20 of the foils 3 and more generally to any member present in the upper portion of the feed module 1.

Each upper opening 82 is preferably associated with a closure element 83 which is capable of closing it. Thus, in the present case, the single upper opening 82 co-operates with a closure element 83 which is formed by a sliding panel which is mounted so as to be vertically movable in translation.

According to another particular feature of the invention which can be seen in FIG. 5, the feed module 1 is provided with control means 70 which are set up near but on the outside of the free space 40 and which are capable of at least partially controlling the stamping machine 100 with which the feed module 1 is associated. This feature allows the stamping machine 100 to be stopped at the last moment before new reels 2 are loaded but particularly allows it to be restarted without any dead time once said loading is complete.

FIGS. 4 and 5 also demonstrate another advantageous feature of the invention. The feed module 1 is bordered by a platform 160, of which at least one section, referred to as the specific section 161, 162, extends at least partially opposite the free space 40. In this configuration, each specific section 161, 162 is advantageously mounted so as to be able to move between a use position, in which it is fully operational along the free space 40 (FIG. 4), and a withdrawn position, in which it is arranged remote from the free space 40, to which it completely opens up access from the outside of the module 1 (FIG. 5).

In the specific embodiment of FIGS. 4 and 5, only the portion of the platform 160 located directly opposite the free space 40 is mounted in a movable manner. This movable portion is divided into two specific sections 161, 162 which are mounted so as to be able to pivot about two transverse axes which are positioned on one side and the other of the module 1, respectively.

Naturally, the invention more generally relates to any stamping printing machine 100 which comprises at least one feed module 1 for supplying stamping foils 3, as described above.

The invention claimed is:

1. Feed module for supplying stamping foil for a stamping printing machine, comprising a support for at least one reel of stamping foil, and a drive for each such stamping foil, wherein:

the support and the drive are set up in a workspace which is arranged in an upper portion of the module, and a lower portion of the module comprises a free space which is laterally accessible from the outside of the module and which communicates with the workspace at a top of the free space;

the free space is configured for receiving and accommodating an external lifting device for at least one reel, and said external lifting device is configured, on the one hand, for transporting each reel during its introduction into the free space; and, on the other hand, for transferring each reel from the free space to the workspace.

2. Feed module according to claim 1, wherein the workspace comprises at least one cross-section which extends substantially vertically and which is configured for the transfer of reels between the free space and the workspace, and the support and the drive are set up outside said at least one cross-section.

3. Feed module according to claim 1, further comprising a separation part which is configured for physically separating the workspace and the free space.

4. Feed module according to claim 1, further comprising a detection part which is capable of identifying any intrusion into the free space from the outside of the module.

5. Feed module according to claim 1, further comprising a control which is set up near but on the outside of the free space, and which at least partially controls a stamping printing machine with which the feed module is associated.

6. Feed module according to claim 1, wherein the workspace and the free space are delimited by a chamber which comprises a lower opening which affords access to the free space from the outside of the module.

7. Feed module according to claim 6, wherein the chamber further comprises at least one upper opening which affords access to the workspace.

8. Feed module according to claim 7, wherein each such upper opening is configured for being closed by a closure element.

9. Feed module according to claim 1, further comprising a platform, having at least one specific section which extends at least partially opposite the free space, said specific section being mounted so as to be movable between a use position, in which it is arranged adjacent to the free space, and a withdrawn position, in which it is arranged remote from the free space, wherein said specific section opens up access to the free space from the outside of the module.

10. Stamping printing machine, comprising:

at least one feed module according to claim 1; and at least one workstation juxtaposed with said feed module, for processing a stamping foil fed from said feed module.

* * * * *